US010186389B2

(12) United States Patent
Aitken et al.

(10) Patent No.: US 10,186,389 B2
(45) Date of Patent: Jan. 22, 2019

(54) CURRENT CONNECTION AND/OR CUT-OFF DEVICE COMPRISING PERMANENT CONTACTS WITH REDUCED WEAR

(71) Applicant: Alstom Technology Ltd., Baden (CH)

(72) Inventors: Oana Aitken, Saint Egreve (FR); Chakib Fnineche, Saint Pierre d'Allevard (FR)

(73) Assignee: ALSTOM TECHNOLOGY LTD, Baden (CH)

( * ) Notice: Subject to any disclaimer, the term of this patent is extended or adjusted under 35 U.S.C. 154(b) by 0 days.

(21) Appl. No.: 14/435,882

(22) PCT Filed: Oct. 17, 2013

(86) PCT No.: PCT/EP2013/071689
§ 371 (c)(1),
(2) Date: Apr. 15, 2015

(87) PCT Pub. No.: WO2014/060498
PCT Pub. Date: Apr. 24, 2014

(65) Prior Publication Data

US 2015/0340179 A1 Nov. 26, 2015

(30) Foreign Application Priority Data

Oct. 19, 2012 (FR) ..... 12 59989

(51) Int. Cl.
*H01H 33/02* (2006.01)
*H01H 33/12* (2006.01)
(Continued)

(52) U.S. Cl.
CPC ..... *H01H 33/025* (2013.01); *H01H 1/02* (2013.01); *H01H 1/0233* (2013.01);
(Continued)

(58) Field of Classification Search
CPC ..... H01H 33/025; H01H 33/12; H01H 33/78; H01H 1/04; H01H 1/38; H01H 33/91; H01H 33/7015; H01H 1/50; H01H 9/38
(Continued)

(56) References Cited

U.S. PATENT DOCUMENTS 400,820 A * 4/1889 Rothkegel et al. ..... B23Q 5/22 29/52
2,504,906 A 4/1950 Tremblay
(Continued)

FOREIGN PATENT DOCUMENTS

DE 4105335 A1 8/1992
DE 4230060 A1 3/1994
(Continued)

OTHER PUBLICATIONS

Search Report issued in French Patent Application No. FR 12 59989 dated Jun. 27, 2013.
(Continued)

*Primary Examiner* — Edwin A. Leon
*Assistant Examiner* — William Bolton
(74) *Attorney, Agent, or Firm* — Pearne & Gordon LLP

(57) ABSTRACT

Device for making and/or breaking a current including a pair of permanent contacts (3, 4), at least one of the contacts (3, 4) being movable. At least one permanent contact (3, 4) including a main portion (3.1, 4.1) having a free end and an end protection portion (3.2, 4.2) secured to the free end of the main portion (3.1, 4.1), designed to be in mechanical and electrical contact with the other permanent contact (4, 3) only during an operation for opening or closing the pair. The end protection portion (3.2, 4.2) is made of a single transition metal having a melting temperature that is strictly higher than that of the main portion (3.1, 4.1) to which it is secured, or of an oxide or carbide of such a metal, or even
(Continued)

of zinc oxide. For application in particular to high- or medium-voltage circuit breakers.

11 Claims, 3 Drawing Sheets

(51) Int. Cl.
*H01H 1/02* (2006.01)
*H01H 1/0233* (2006.01)
*H01H 1/0237* (2006.01)
*H01H 1/38* (2006.01)
*H01H 33/78* (2006.01)

(52) U.S. Cl.
CPC ..... *H01H 1/0237* (2013.01); *H01H 1/385* (2013.01); *H01H 33/12* (2013.01); *H01H 33/78* (2013.01); *H01H 2201/008* (2013.01); *H01H 2201/026* (2013.01)

(58) Field of Classification Search
USPC ..... 218/146, 132, 16, 19, 48
See application file for complete search history.

(56) References Cited

U.S. PATENT DOCUMENTS

| | | | | |
|---|---|---|---|---|
| 3,424,884 | A * | 1/1969 | Floessel | H01H 33/7038 218/22 |
| 4,205,209 | A | 5/1980 | Thuries | |
| 5,272,295 | A * | 12/1993 | Sawada | H01H 1/0233 200/267 |
| 5,453,591 | A | 9/1995 | Stroud | |
| 5,567,923 | A | 10/1996 | Perret | |
| 6,100,492 | A | 8/2000 | Zehnder et al. | |
| 6,211,478 | B1 | 4/2001 | Schoenemann et al. | |
| 7,679,021 | B2 * | 3/2010 | Gericke | H01H 11/041 218/48 |
| 2006/0121292 | A1 * | 6/2006 | Weaver | C23C 4/02 428/457 |
| 2006/0278507 | A1 | 12/2006 | Renner et al. | |
| 2007/0074963 | A1 | 4/2007 | Gericke et al. | |
| 2009/0294406 | A1 | 12/2009 | Bessede | |
| 2012/0001255 | A1 | 1/2012 | Park | |
| 2012/0012558 | A1 * | 1/2012 | Nagao | H01H 1/023 218/65 |
| 2013/0292153 | A1 | 11/2013 | Fnineche | |

FOREIGN PATENT DOCUMENTS

| | | | |
|---|---|---|---|
| DE | 19837945 | A1 | 2/2000 |
| DE | 10353497 | A1 | 6/2005 |
| EP | 0 932 172 | A2 | 7/1999 |
| EP | 0 951 038 | A1 | 10/1999 |
| EP | 0951038 | A1 | 10/1999 |
| EP | 0982748 | A1 | 3/2000 |
| EP | 1 675 142 | A1 | 6/2006 |
| EP | 1 837 889 | A2 | 9/2007 |
| EP | 1837889 | A2 | 9/2007 |
| WO | 2004095485 | A1 | 11/2004 |

OTHER PUBLICATIONS

International Search Report issued in Application PCT/EP2013/071689 dated Jan. 3, 2014.
Written Opinion issued in Application PCT/EP2013/071689 dated Jan. 3, 2014.

* cited by examiner

CURRENT CONNECTION AND/OR CUT-OFF DEVICE COMPRISING PERMANENT CONTACTS WITH REDUCED WEAR

TECHNICAL FIELD

The present invention relates to the field of devices for making and/or breaking current, the devices having reduced-wear permanent contacts, in particular for high or medium voltage.

In this context, the terms "medium voltage" and "high voltage" are used in their conventionally accepted ways. The term "medium voltage" refers to a voltage that lies in the range 1 kilovolt (kV) to 52 kV for alternating current (AC) and that lies in the range 1.5 kV to 75 kV for direct current (DC). The term "high voltage" refers to a voltage that is strictly greater than 52 kV for AC and strictly greater than 75 kV for DC.

The device for making and/or breaking a current with permanent contacts may in particular be a circuit breaker, a disconnector, a switch, a contactor.

PRIOR ART

A device for making and/or breaking electric current comprises in a breaking chamber filled with a dielectric fluid, such as sulfur hexafluoride, a pair of permanent contacts and a pair of arcing contacts. Generally, in each pair, one of the contacts is stationary and the other is movable in such a manner as to be able, by moving the movable contacts, to cause the device for making and/or breaking electric current to pass from a closed position to an open position and vice-versa. In a variant, the contacts of a pair may both be movable.

During operation of the contacts of the device aiming to make said contacts take up an open position, starting from a closed position in which they are conducting electricity, the permanent contacts separate and an electric arc appears between said contacts, which electric arc is referred to as a "switching arc". After that switching arc has been extinguished, the current continues to flow through the arcing contacts. Then the arcing contacts also separate, which causes an electric arc to be struck between said arcing contacts. The dielectric fluid makes it possible to cool the arc and to extinguish it.

That switching arc is characterized by a very large amount of energy that it is sought to minimize, firstly in order to guarantee fast switching, and secondly to minimize wear of the permanent contacts. Wear of the contacts leads: to a mechanical weakening of the zones of those contacts that come into contact when the device is in the closed position; to production of metal particles that lead to dielectric arcing between live parts and parts that are at ground potential; and to a modification of the geometrical shape of the contacts, leading to a reduction in the quality of the electrical contact in the closed position. The energy of the arc depends on the voltage of the arc, the current of the arc, and on the switching time.

U.S. patent application Ser. No. 2006/278507 describes an arcing contact comprising a tungsten overlay soldered onto a metal support by means of silver or copper, the support and the solder layer being covered with a protection layer of tin, zinc, magnesium, or aluminum. That configuration is not satisfactory because the silver, the copper, and the materials recommended for the protection layer do not remain inert in the presence of an electric arc and they erode and vaporize.

In U.S. Pat. No. 6,211,478, it is recommended to provide an arcing contact with a coating of a sintered material formed from a mixture of two metals, one metal having a melting temperature higher than 2000° C. and the other having a melting temperature lower than 2000° C. A material presented as being particularly advantageous is a mixture of copper and tungsten with 80% tungsten and 20% copper, those percentages being percentages by weight.

A drawback of the configuration presented above is that it is expensive, since the coating requires sintering before being deposited.

Another drawback is that with the recommended mixture, when the electric arc is established, there is vaporization of the metal having the low melting temperature, wear of the contact, and dispersion of metal particles inside the breaking chamber.

The duration of an electric arc formed between the arcing contacts is much longer than that of a switching arc. It lasts from a few milliseconds to a few tens of milliseconds. The duration of a switching electric arc does not exceed about 2 milliseconds. Using a coating of non-alloyed metal having a high melting temperature on the arcing contact means that the energy of the arc is easily transferred, by conduction, to the arcing contact that supports said coating, said arcing contact generally being made of copper. The support thus becomes damaged.

In patent application EP 1 837 889, the movable permanent contact is in the form of a hollow cylinder, the stationary permanent contact is formed by two coaxial hollow cylinders. In the closed position, the movable contact is inserted between the two coaxial cylinders of the stationary permanent contact. Those two coaxial cylinders are offset laterally relative to each other, the outer cylinder when in an open position being closer to the movable permanent contact than the inner cylinder. In the closed position, the outer surface of the movable permanent contact and the inner surface of the outer cylinder are not in mechanical contact; a space is provided between them.

The movable contact is terminated internally by a contact flange, and externally it is coated with an erosion-resistant material, situated around the flange. The flange comes into mechanical and electrical contact with the outer surface of the inner cylinder in the closed position.

The outer cylinder is coated internally at its end with an erosion-resistant material.

That configuration is not satisfactory either. Said configuration is expensive, bulky, and heavy because of the two cylinders of the stationary permanent contact. There still exists the risk of the contacts between the flange and the outer surface of the inner cylinder being worn and of metal particles being emitted into the breaking chamber. Using two stationary permanent contacts requires them to be finely adjusted relative to each other, with the outer contact projecting relative to the inner contact in such a manner as to attract the electric arc. Those accurate adjustments are not easy.

SUMMARY OF THE INVENTION

An object of the present invention is to provide a device for making and/or breaking high- or medium-voltage current that does not present the above-mentioned drawbacks.

An object of the invention is in particular to provide such a device for making and/or breaking a current that has increased longevity due to reduced wear of its permanent contacts, yet without increasing its size, its weight, or its cost.

Another object of the invention is to reduce the mechanical fragility of the permanent contacts in a device for making and/or breaking a current, yet without increasing its size, its weight or its cost.

An additional object of the invention is to preserve the quality of contact for longer than in the prior art for such a device for making and/or breaking a current.

Another additional aim of the invention is to limit electrical striking in the breaking chamber of such a device for making and/or breaking a current.

A further additional aim of the invention is to make a device for making and/or breaking current having permanent contacts and having a reduced switching time, a reduced arcing voltage at the terminals of the main circuit and a reduction of arcing current flowing in the main circuit when an electric arc is established.

In order to achieve these objects, the invention provides more precisely to a device for making and/or breaking current comprising a pair of permanent contacts, at least one of the contacts of the pair being movable. At least one permanent contact of the pair comprises a main portion having a free end and an end protection portion that is secured to the free end of the main portion; the end protection portion being designed to be in mechanical and electrical contact with the other permanent contact of the pair of permanent contacts only during an operation for opening or closing the pair of permanent contacts, said end protection portion being made of a single transition metal, said transition metal having a melting temperature that is strictly higher than that of the main portion to which it is secured, or of an oxide of such a metal, or of a carbide of such a metal, or even of zinc oxide.

When the main portion is made of copper, of copper alloy, or of aluminum possibly coated in silver, the transition metal is preferably selected from: tungsten, molybdenum, cobalt, titanium, zirconium, chromium, or nickel.

The end protection portion may take the form of a coating at the surface of the free end of the main portion.

The coating preferably has a thickness lying in the range about 50 micrometers (μm) to 300 μm.

In a variant, end protection portion may take the form of an endpiece fastened by screw-fastening or adhesive to the free end of the main portion. Advantageously, said endpiece is solid.

It may be envisaged that the main portion is formed of a plurality of successive elements assembled together, one of which forms the free end of the main portion.

The permanent contact provided with the end protection portion may substantially take the form of a hollow cylinder.

In a variant, or in combination, the permanent contact provided with the end protection portion takes the form of a collar provided with a plurality of fingers.

According to the invention, the device for making and/or breaking current may further comprise at least one pair of arcing contacts.

The device for making and/or breaking a current may be a circuit breaker, a disconnector, a switch, a contactor.

BRIEF DESCRIPTION OF THE DRAWINGS

The present invention can be better understood on reading the description of embodiments, given purely as examples and in non-limiting manner, and made with reference to the accompanying drawings, in which.

Identical portions, similar or equivalent to the various figures described below carry the same numerical references so as to facilitate passing from one figure to the other.

The various portions shown in the figures are not necessarily shown to a uniform scale, in order to make the figures easier to read.

In FIGS. 1A-1C and 3, for the purpose of clarity, hatching is applied only to the permanent contacts.

DETAILED DESCRIPTION OF PARTICULAR EMBODIMENTS

Figure 1A:
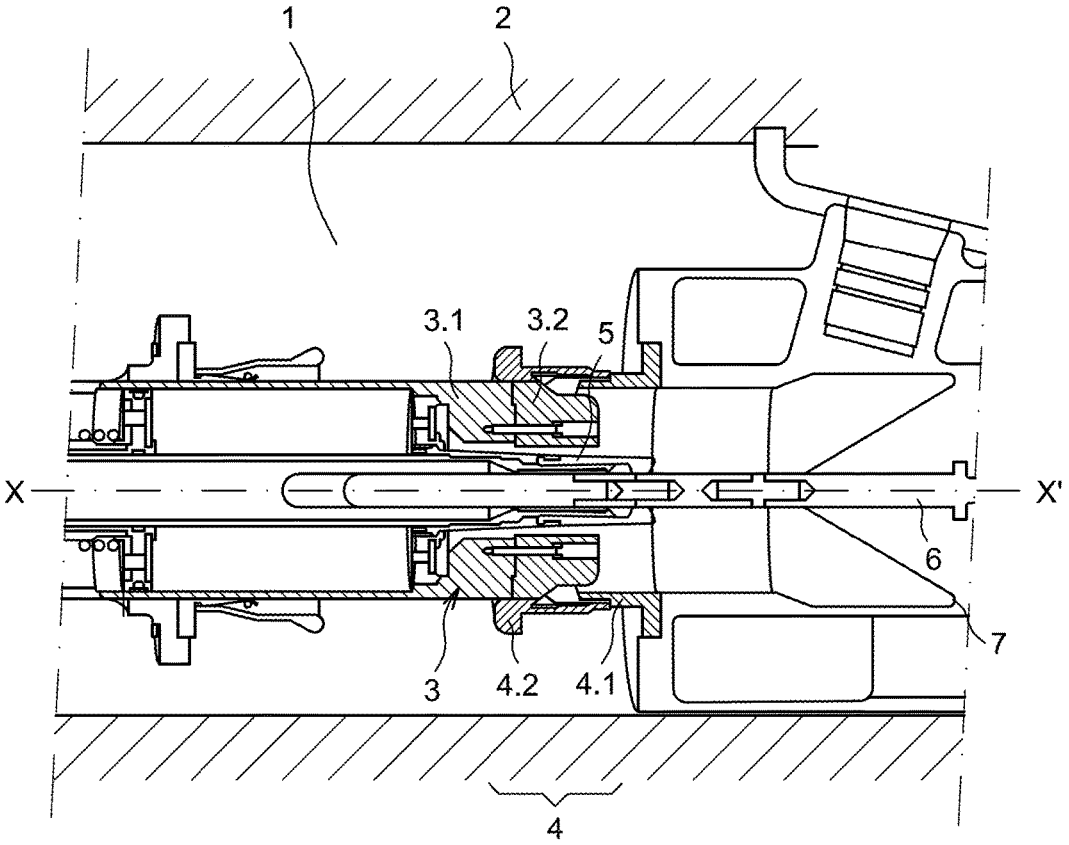
FIG. 1A shows in longitudinal section an example of a device of the invention for making and/or breaking a current during an operation of opening the pair of permanent contacts.

FIG. 1A shows, in longitudinal section, a current-breaking chamber for an example of a device for making and/or breaking current that is the subject matter of the invention. It may be assumed that this device for making and/or breaking current is a high-voltage circuit breaker, but it should naturally be understood that it could be any other type of high- or medium-voltage equipment such as those mentioned above. Below, the term "circuit breaker" is used in non-limiting manner.

The circuit breaker comprises a current-breaking chamber 1 defined by an insulating casing 2 extending along a longitudinal axis XX', the chamber being leaktight and filled with a dielectric fluid such as sulfur hexafluoride. This insulating casing 2 houses a pair of permanent contacts 3, 4, one of which is movable along the longitudinal axis XX' under the action of a rod (not shown) and the other of which is stationary. The movable permanent contact bears the reference 3 and the stationary permanent contact bears the reference 4.

The casing further houses a pair of arcing contacts 5, 6, one of which is movable along the longitudinal axis XX'. The movable arcing contact bears the reference 5 and the other arcing contact bears the reference 6. The movable permanent and arcing contacts are secured to each other and therefore they move simultaneously during an opening or closing operation of the circuit breaker. The circuit breaker described above is a self compression circuit breaker and it further comprises an arc-extinction nozzle 7 having an orifice that is closed by the other arcing contact 6.

It should be noted that in a variant, both of the permanent contacts of the pair could be movable and not just one of them. In the same way, both arcing contacts of the pair could be movable and not just one of them.

In the example described, the movable arcing contact 5 surrounds the stationary arcing contact 6, whereas the movable permanent contact 3 is surrounded by the stationary permanent contact 4. The movable permanent contact 3 takes the form of a hollow cylinder. The stationary permanent contact 4 takes the form of a collar provided with fingers that project towards the movable permanent contact 5.

In the example described in FIG. 1A, the circuit breaker is in the process of opening, however, both the pair of permanent contacts and the pair of arcing contacts are still closed.

The path of the nominal current is established between the two permanent contacts 3, 4 of the pair of permanent contacts, they are in mutual mechanical and electrical contact. That is why these two contacts are considered to be permanent. The arcing contacts 5, 6 of the pair of arcing contacts are also in mutual mechanical and electrical contact. During the operation, the pair of permanent contacts opens first. On separation of the permanent contacts 3, 4, an electric arc is established between them. Then, the current passes through the pair of arcing contacts that is still closed. When the arcing contacts 5, 6 separate, an electric arc is established between them. The dielectric gas is strongly heated and the pressure inside the casing increases. As a result of an effect of dielectric fluid compression, a stream of cold gas is blown onto the electric arc and extinguishes it.

In high-voltage circuit breakers, the nominal current passing in the main circuit via the permanent contacts is generally less than 5 kiloamps (kA) whereas the default current passing in the same circuit is generally of the order of several tens of kilos amps or even several hundreds of kilos amps. The electric switching arc is characterized by a very high temperature. For a current of 50 kA, said arc may reach temperatures higher than 4700° C. Such a temperature promotes wear of the permanent contacts of conventional circuit breakers; mechanical weakening of their ends; geometrical modification of their shape due to erosion; and metal particles are emitted into the breaking chamber. An increase in electrical contact resistances is observed and therefore increased temperature rises are observed, as is a risk of electric arcs striking due to the presence of metal particles that may be deposited on insulating parts. The performance of the circuit breaker may also be reduced.

Figure 2:
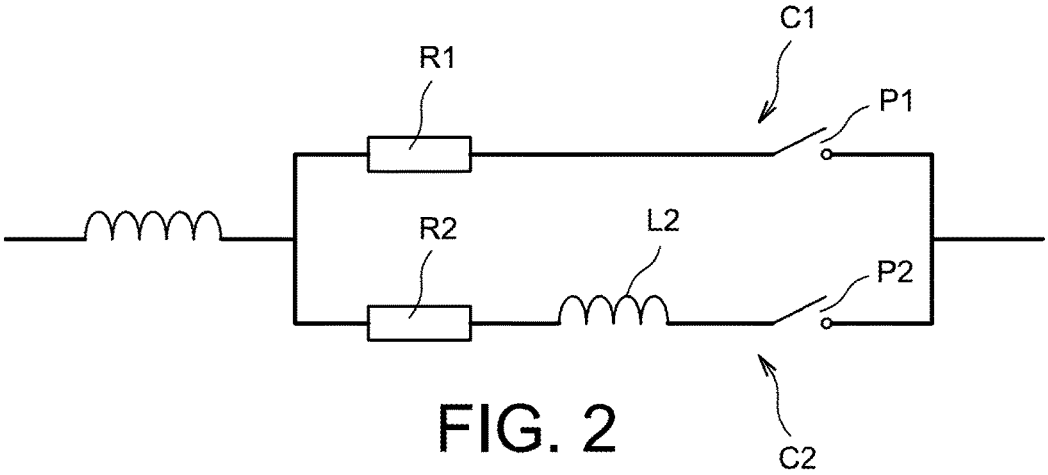
FIG. 2 shows an equivalent circuit diagram of the device for making and/or breaking a current.

In order to avoid damaging at least one permanent contact 3, 4 of the pair of permanent contacts, the idea is to reduce the energy and the duration of the electric arc that is established between them. FIG. 2 shows a model of the circuit diagram of the circuit breaker with a main circuit C1 including the pair of permanent contacts P1 and the arc circuit C2 with the pair of arcing contacts P2, these two circuits C1, C2 being connected in parallel. The main circuit C1 is resistive and the arc circuit C2 is an R-L series circuit. The resistance of the main circuit is designated R1. The inductance of the arc circuit C2 is designated L2, and its resistance designated R2.

The contact pairs P1, P2 are shown closed. The resistances R1, R2 include the contact resistances of each pair of contacts P1, P2. The inductance L2 in the arc circuit C2 includes the inductance of the dielectric fluid.

One solution for reducing the arcing energy is to increase the resistance of at least one of the permanent contacts of each pair in order to increase the resistance of the main circuit.

Once again reference is made to FIG. 1A and more particularly to the permanent contact 3. This permanent contact 3 comprises a main portion 3.1 having a free end and an end protection portion 3.2 secured to the free end of the main portion 3.1. The end protection portion 3.2 is made with a single transition metal, said single transition metal having a melting temperature that is strictly higher than the temperature of the main portion 3.1 that the end protection portion protects. This end protection portion 3.2 is in mechanical and electrical contact only with the other permanent contact 4 of the pair during an operation of opening (before the appearance of an electric arc) or closing the pair of permanent contacts. More generally, in the event of closing when current is present, the electric arc appears between the non-closed contacts when the distance is sufficient for striking the arc. The arc is extinguished when the contacts are "in contact". In the closed position, it is the main portion 3.1 that provides the mechanical and electrical contact with the other permanent contact 4 of the pair of permanent contacts. In the open position, there is no mutual electrical and mechanical contact.

As seen below, if said other permanent contact 4 also has a main portion 4.1 and an end protection portion 4.2, the mechanical and electrical contact is made between the two main portions 3.1, 4.1 in continuous conditions (closed position) and between the two end protection portions 3.2, 4.2 during the opening or closing stage of operation.

In the present application, it is considered that the transition metals are chemical elements having atomic numbers of 21 to 30, 39 to 48, and 72 to 80.

If the main portion is made of copper, having a melting temperature of 1084° C., the transition metals that have a melting temperature that is higher than that of the copper are the following: scandium, titanium, vanadium, chromium, manganese, iron, cobalt, nickel, yttrium, zirconium, niobium, molybdenum, technetium, ruthenium, rhodium, palladium, hafnium, tantalum, tungsten, rhenium, osmium, iridium, and platinum. Some of these transition metals are rare and therefore expensive. By way of example, transition metals that are preferred for the end protection portion are: tungsten, molybdenum, cobalt, titanium, zirconium, chromium, and nickel because they are commonly used with electricity and are less expensive. They are completely suitable when the main portion is made of copper or a copper alloy such as CuCr, CuCrZr, CuZr, or even of aluminum, these materials generally being silver-plated. In this event, the material of the end protection portion has a melting temperature that is higher than that of silver, copper or copper alloy, or aluminum.

The melting temperatures of said transition metals are given in brackets below: tungsten (3407° C.), molybdenum (2617° C.), cobalt (1495° C.), titanium (1660° C.), zirconium (1854° C.), chromium (1857° C.), nickel (1455° C.). The melting temperature of copper is 1084° C., the temperature of silver is 961° C., and the temperature of aluminum is 660° C. The transition metals mentioned above for protecting copper, its alloys CuCr, CuCrZr, CuZr, or aluminum all have resistivity that is greater than that of copper and aluminum. By using an end protection portion made of one of these metals, the resistance of the main circuit is indeed increased.

In a variant, it is possible to make the end protection portion out of an oxide of such a transition metal, a carbide of such a transition metal, or even zinc oxide, the melting temperature of zinc oxide being 1975° C.

The main portion 3.1 may be in one piece or in multiple pieces.

Figure 1B:
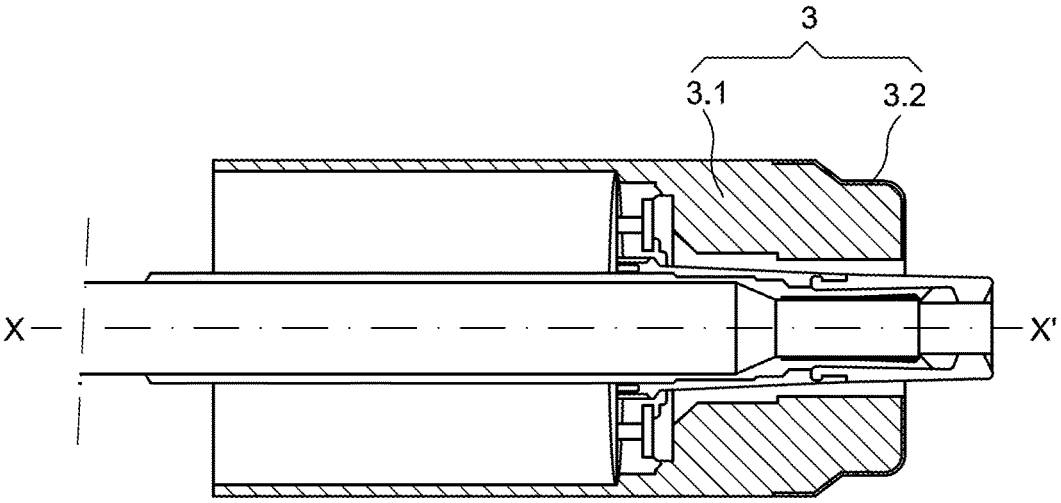
FIGS. 1B to 1C show variants of permanent contacts of the device.

The end protection portion 3.2 may take the form of a coating that extends at least over the free end of the main portion 3.1 and that extends laterally on the surface of the main portion 3.1 in such a manner as to face the other permanent contact 4 of the pair, when the pair of permanent contacts is in an opening or closing stage of operation. There is no mechanical and electrical contact between the coating and the other permanent contact when the pair of permanent contacts is closed, therefore only the main portions are in mechanical and electrical contact. FIG. 1B shows this configuration of the coating 3.2 and of the one-piece main portion 3.1.

The thickness of the coating may lie in the range about 50 μm to 300 μm, for example.

It may be deposited by thermal spraying, this technique making it possible to deposit thick coatings on supports of a variety of natures. This technique uses a vector gas designed to accelerate and transport liquid, pasty, or solid particles of the coating to the support.

This thermal spraying technique includes in particular: torch or flame spraying; high velocity oxy-fuel (HVOF) spraying, wire arc spraying, blown arc plasma spraying, or even the more recent spraying technique known as cold spraying.

Figure 1C:
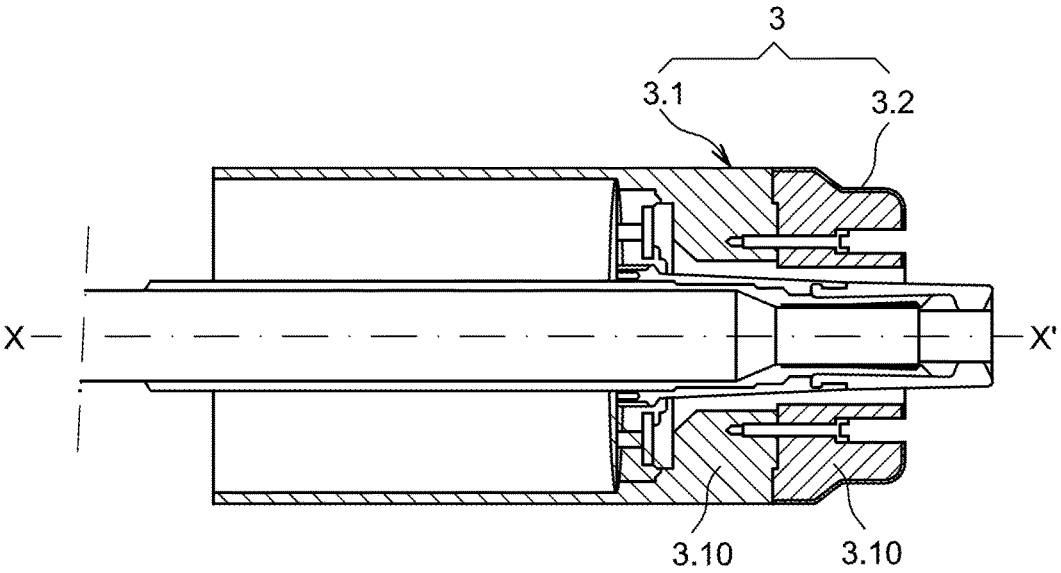
Figure 3:
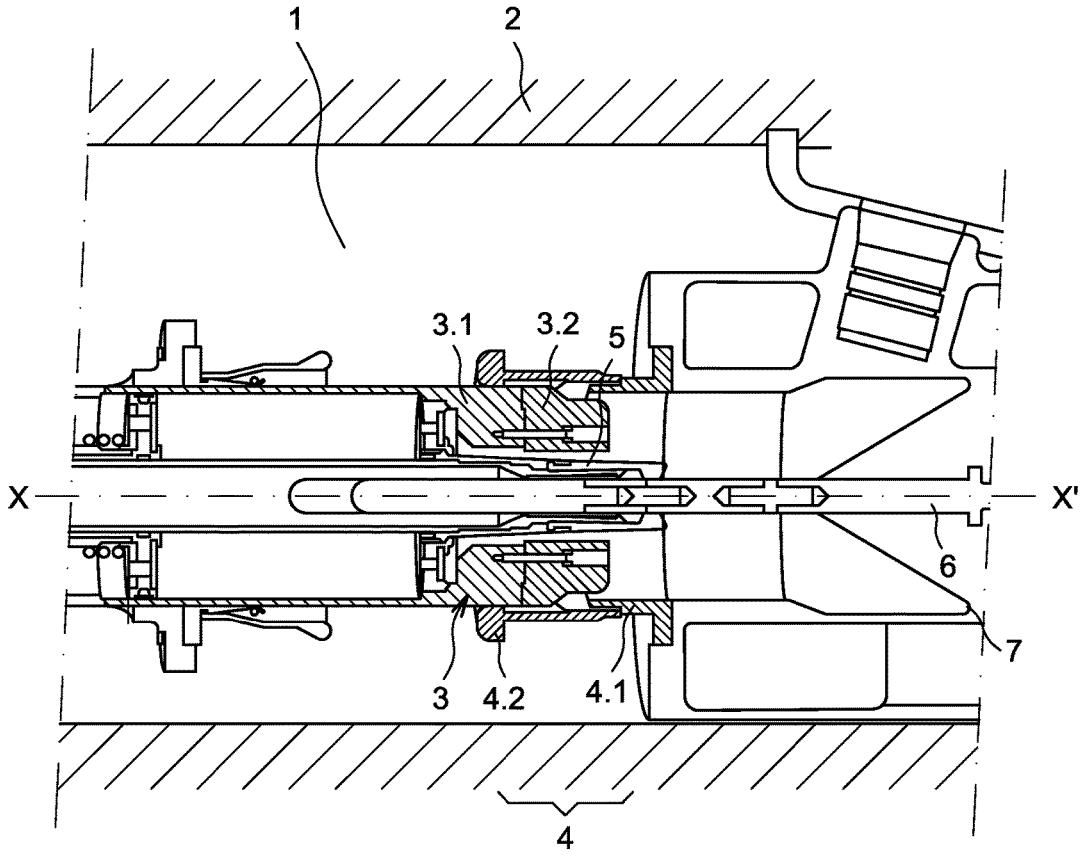
FIG. 3 shows in in longitudinal section an example of a device of the invention for making and/or breaking a current, the device in a closed position.

The main portion 3.1, when it is made up of multiple pieces comprises a plurality of main elements 3.10 placed end to end, secured to one another by screw-fastening or adhesive, for example. One of the main elements is an end main element 3.10. The end protection portion may be formed by a coating that covers the end main element as shown in FIG. 1C. In this embodiment also, it is arranged for the coating to cover the end of the permanent contact and its surface, this coating being without electrical and mechanical contact with the other permanent contact of the pair, in continuous conditions when the circuit breaker is closed.

FIG. 1A shows a variant in which the end protection portion 3.2 is a solid endpiece made of the recommended material, said endpiece being fitted by screw-fastening or adhesive to the end of the main portion 3.1.

Above, the end protection portion 3.2 is described as belonging to a single one of the permanent contacts: the movable permanent contact. This permanent contact takes the form of a cylinder, preferably a hollow cylinder, in order to reduce both its weight and the energy required to set it into movement.

Naturally, it may be envisaged for the end protection portion 4.2 to belong to the other permanent contact 4, which contact surrounds the movable permanent contact 3. This variant is shown in FIG. 1A. The other permanent contact 4 may have its main portion 4.1 in the shape of a collar from which fingers project towards the movable permanent contact 3. The free ends 4.2 of the fingers serve as end protection portions and are made of the recommended material. The ends of each of the fingers are designed to come into mechanical and electrical contact with the movable permanent contact when the circuit breaker is in the opening or closing stage of operation.

In a variant, it may be envisaged for the two permanent contacts of the pair to be fitted with the end protection portion as shown in FIG. 1A.

The device for making and/or breaking a current need not be a circuit breaker, but may be a disconnector, a switch, or a contactor.

Although several embodiments of the present invention are shown and described in detailed manner, it should be understood that various changes and modifications may be made without going beyond the ambit of the invention. Zone Name: A2,AMD

What is claimed is:

1. A device for making and/or breaking a current, the device comprising:

a pair of permanent contacts, at least one of the permanent contacts of the pair of permanent contacts being movable;

a pair of arcing contacts, at least one of the arcing contacts being movable;

a closed position wherein the arcing contacts are in mechanical and electrical contact with each other, and wherein the permanent contacts are in mechanical and electrical contact with each other;

an open position wherein the arcing contacts are not in mechanical nor in electrical contact with each other, and wherein the permanent contacts are not in mechanical nor in electrical contact with each other;

wherein the arcing contacts and the permanent contacts are configured so that, during a transition from the closed position to the open position of the device, the electrical contact between the permanent contacts is broken before the electrical contact of the arcing contacts; and wherein at least one permanent contact of the pair of permanent contacts comprises a main portion having a free end and an end protection portion secured to the free end of the main portion, the end protection portion being designed to be in mechanical and electrical contact with the other permanent contact of the pair of permanent contacts only during an operation for opening or closing the pair of permanent contacts, said end protection portion being made of a single transition metal, said transition metal having a melting temperature that is higher than that of the main portion to which it is secured, or of an oxide of such a metal, or of a carbide of such a metal, or of zinc oxide.

2. The device for making and/or breaking the current according to claim 1, wherein the main portion is made of copper, of copper alloy, or of aluminum, or aluminum coated in silver, and the transition metal is chosen from: tungsten, molybdenum, cobalt, titanium, zirconium, chromium, or nickel.

3. The device for making and/or breaking the current according to claim 1, wherein the end protection portion is a coating at a surface of the free end of the main portion.

4. The device for making and/or breaking the current according to claim 3, wherein the coating has a thickness within a range of about 50 μm to 300 μm.

5. The device for making and/or breaking the current according to claim 1, wherein the main portion is formed of a plurality of successive elements assembled to one another, one of which elements forms the free end of the main portion.

6. The device for making and/or breaking the current according to claim 1, wherein the end protection portion is an endpiece fastened by screw-fastening or adhesive to the free end of the main portion.

7. The device for making and/or breaking the current according to claim 6, wherein the endpiece is monolithic.

8. The device for making and/or breaking the current according to claim 1, wherein the permanent contact provided with the end protection portion comprises a hollow cylinder.

9. The device for making and/or breaking the current according to claim 1, wherein the permanent contact provided with the end protection portion comprises a collar provided with a plurality of fingers.

10. The device for making and/or breaking the current according to claim 1, wherein the device is a circuit breaker, a disconnector, a switch, or a contactor.

11. A device for making and/or breaking a current, the device comprising:

a pair of permanent contacts, at least one of the permanent contacts of the pair of permanent contacts being movable;

a pair of arcing contacts, at least one of the arcing contacts being movable;

a closed position wherein the arcing contacts are in mechanical and electrical contact with each other, and wherein the permanent contacts are in mechanical and electrical contact with each other;

an open position wherein the arcing contacts are not in mechanical nor in electrical contact with each other, and wherein the permanent contacts are not in mechanical nor in electrical contact with each other;

wherein the arcing contacts and the permanent contacts are configured so that, during a transition from the closed position to the open position of the device, the electrical contact between the permanent contacts is broken before the electrical contact of the arcing contacts; and wherein at least one permanent contact of the pair of permanent contacts comprises a main portion having a free end and an end protection portion secured to the free end of the main portion, the end protection portion being designed to be in mechanical and electrical contact with the other permanent contact of the pair of permanent contacts only during an operation for opening or closing the pair of permanent contacts, said end protection portion being designed so that, in the closed position of the device, the end protection portion is separated from the other permanent contact of the pair of permanent contacts, and said end protection portion being made of a single transition metal, the transition metal having a melting temperature that is strictly higher than that of the main portion to which it is secured, or of an oxide of such a metal, or of a carbide of such a metal, or of zinc oxide.

* * * * *